US007156708B2

(12) United States Patent
Dudra

(10) Patent No.: US 7,156,708 B2
(45) Date of Patent: Jan. 2, 2007

(54) MARINE STEERING ASSEMBLY WITH INTEGRATED PIVOT PIN

(75) Inventor: Brian James Dudra, Vancouver (CA)

(73) Assignee: Teleflex Canada Incorporated, Richmond (CA)

( * ) Notice: Subject to any disclaimer, the term of this patent is extended or adjusted under 35 U.S.C. 154(b) by 150 days.

(21) Appl. No.: 10/877,984

(22) Filed: Jun. 29, 2004

(65) Prior Publication Data

US 2005/0287884 A1 Dec. 29, 2005

(51) Int. Cl.
*B63H 5/125* (2006.01)
*B63H 20/08* (2006.01)

(52) U.S. Cl. ..... 440/61 S; 114/150

(58) Field of Classification Search ..... 440/61 R, 440/61 S, 61 A, 61 B, 61 C, 53, 63; 114/150
See application file for complete search history.

(56) References Cited

U.S. PATENT DOCUMENTS 5,092,801 A 3/1992 McBeth et al.
5,997,370 A * 12/1999 Fetchko et al. ..... 440/61 R
6,406,340 B1 6/2002 Fetchko et al.

FOREIGN PATENT DOCUMENTS

JP 04362494 A * 12/1992
JP 06156389 A * 6/1994
JP 06206592 A * 7/1994

* cited by examiner

*Primary Examiner*—Ajay Vasudeva
(74) *Attorney, Agent, or Firm*—Norman M Cameron

(57) ABSTRACT

There is provided a hydraulic steering assembly for applying a force to a tiller of a marine, outboard propulsion unit. The steering assembly comprises a hydraulic steering actuator including a cylinder and an elongated piston rods. A pivot member is pivotally mounted on the tiller of the propulsion unit for pivoting about a first link axis which is parallel to the steering axis. There is a pair of actuator arms, each actuator arm being connected to the cylinder and having a portion extending radially outwards with respect to the piston rod axis. Each actuator arm includes an integral cylindrical projection. The pivot member has a complementary cylindrical recess for each integral cylindrical projection and the pivot member thereby rotatably receives each cylindrical projection. Preferably, each cylindrical projection and actuator arm comprise one piece. At least one of the actuator arms is removable.

14 Claims, 6 Drawing Sheets

MARINE STEERING ASSEMBLY WITH INTEGRATED PIVOT PIN

BACKGROUND OF INVENTION

This invention relates to marine steering systems and, in particular, to marine hydraulic steering systems for steering outboard motors which can tilt relative to the stern of a marine craft.

Marine steering systems have been developed for hydraulically steering outboard motors, but which permit tilting upwards of the outboard motors when the motors are not in use. Such steering systems conventionally included a steering wheel with an associated hydraulic pump and hydraulic lines connecting the pump to a steering assembly adjacent to the outboard motor. Such a system is disclosed, for example, in U.S. Pat. No. 5,997,370 to Fetchko et al. and in earlier U.S. Pat. No. 5,092,801 to McBeth. A system for steering twin outboard motors is disclosed in U.S. Pat. No. 6,406,340 to Fetchko et al.

Typically the systems include a pivot plate or pivot member which is pivotally connected to the tiller of an outboard motor. A pair of support arms or support brackets extend outwardly from the tilt tube of the motor. The piston rod of a hydraulic actuator is mounted on the support arms. The actuator has actuator arms extending outwardly from the cylinder thereof which are pivotally connected to the pivot member for pivoting about an axis parallel to the piston rod. The pivotal connection typically includes cylindrical passageways in the actuator arms and the pivot plate and separate pins extending through the cylindrical passageways which are retained by bolts.

In these earlier systems the actuator arms are typically formed in one piece with the barrel of the hydraulic cylinder. The cylinder has separate end glands connected to the barrel which slidably and sealingly receive the piston rod so that the piston rod reciprocates through the end glands.

This arrangement requires separate bolts or pins for connecting the hydraulic actuator to the pivot plate. Typically this requires two bolts, two washers and two pins. The pins are usually made of a high-strength material with high wear resistance in order to withstand the loads encountered.

SUMMARY OF INVENTION

According to one aspect of the invention, there is provided a hydraulic steering assembly for applying a force to a tiller of a marine, outboard propulsion unit and for rotating said propulsion unit about a steering axis between a center position and hard over positions to each side of the center position. The propulsion unit is supported for arcuate movement about a tilt axis which is generally perpendicular to the steering axis. The steering assembly comprises a hydraulic steering actuator including a cylinder and an elongated piston rod reciprocatingly mounted within the cylinder and extending through the cylinder for movement along a piston rod axis. The piston rod has opposite ends. A pair of support arms is pivotable about the tilt axis of said propulsion unit and is connected to the piston rod near the opposite ends thereof, the support arms allowing arcuate movement of the rod about the tilt axis, maintaining the rod axis parallel to the tilt axis. A pivot member is pivotally mountable on the tiller of said propulsion unit for pivoting about a link axis which is parallel to the steering axis. There is a pair of actuator arms, each arm being connected to the cylinder and extending radially outwards with respect to the piston rod axis, each of the actuator arms having an integral cylindrical projection aligned with the second link axis and rotatably received within a complementary cylindrical recess of the member, thereby pivotally connecting the actuator arms to the member.

Preferably the cylinder includes a barrel with opposite ends and an end fitting connected to the barrel at each end thereof. The piston rod extends slidably through the end fittings, the actuator arms being integral with the end fittings.

According to another aspect of the invention, there is provided a hydraulic steering assembly for applying a force to a tiller of a marine, outboard propulsion unit and for rotating said propulsion unit about a steering axis between a center position and hard over positions to each side of the center position. The propulsion unit is supported for arcuate movement about a tilt axis which is generally perpendicular to the steering axis. The steering assembly comprises a hydraulic steering actuator including a cylinder and an elongated piston rod reciprocatingly mounted within the cylinder and extending through the cylinder for movement along a piston rod axis. The piston rod has opposite ends. A pair of support arms is pivotable about the tilt axis of the propulsion unit and is connected to the piston rod, allowing arcuate movement of the rod about the tilt axis, maintaining the rod axis parallel to the tilt axis. A member is pivotally mounted on the tiller of the propulsion unit for pivoting about a link axis which is parallel to the steering axis. There is a pair of actuator arms, each actuator arm being connected to the cylinder and extending radially outwards with respect to the piston rod axis. Each of the actuator arms has a cylindrical recess aligned with the second link axis. The member has a pair of integral cylindrical projections rotatably received within the recesses, thereby pivotally connecting the actuator arms to the member.

According to a further aspect of the invention, there is provided an end member for a hydraulic actuator for a marine hydraulic steering system. The actuator has a cylindrical barrel and a longitudinal actuator axis. The end member has a fitting for connecting the end member to one end of the barrel, and an arm configured to extend radially outwards from the actuator axis when the member is connected to the one end of the barrel. A cylindrical projection extends from the arm so as to be parallel to the actuator axis, whereby the hydraulic actuator can be pivotally mounted by inserting the cylindrical projection rotatably in a complementary recess of another component of the steering system.

According to a still further aspect of the invention, there is provided a hydraulic steering assembly for applying a force to a tiller of a marine, outboard propulsion unit and for rotating said propulsion unit about a steering axis between a center position and hard over positions to each side of the center position, the propulsion unit being supported for arcuate movement about a tilt axis which is generally perpendicular to the steering axis. The steering assembly comprises a hydraulic steering actuator including a cylinder and an elongated piston rod reciprocatingly mounted within the cylinder and extending through the cylinder for movement along a piston rod axis. The piston rod has opposite ends. A pair of support arms is pivotable about the tilt axis of said propulsion unit and is connected to the piston rod near the opposite ends thereof. The support arms allow arcuate movement of the rod about the tilt axis, maintaining the rod axis parallel to the tilt axis. A pivot member is pivotally mounted on the tiller of said propulsion unit for pivoting about a link axis which is parallel to the steering axis. There is a pair of actuator arms, each said actuator arm being connected to the cylinder and extending radially outwards with respect to the piston rod axis. There is a pivotal connection between each said actuator arm and said pivot member including a cylindrical projection integral with one of said each arm and said pivot member and a complementary cylindrical recess on another of said each arm and said pivot member rotatably receiving the cylindrical projection. The pivotal connection permits relative pivoting between the actuator arms and the pivot member about a second link axis According to a still further aspect of the invention, there is provided a pivot member for a hydraulic steering assembly having a linear steering actuator for applying a force to a tiller of a marine, outboard propulsion unit and for rotating said propulsion unit about a steering axis between a center position and hard over positions to each side of the center position. The pivot member includes means for pivotally mounting the pivot member on the tiller of said propulsion unit for pivoting about a link axis which is parallel to the steering axis. The pivot member has integral spaced-apart cylindrical projections rotatably receivable in complementary cylindrical recesses of the actuator, whereby the actuator is pivotally mounted on the pivot member.

The invention offers notable advantages compared to the prior art. It does away with a significant number of parts compared to a typical prior art unit, including two bolts, two washers and two pins and consequently reduces costs and assembly time.

The invention also allows the pivot plate or other pivot member to be removed much more easily. This is beneficial because some applications require the pivot plate to be mounted upside down or even require an alternative plate, thus making the easy removal of the pivot plate very convenient for the end users.

Also the previous designs are more difficult to disassemble and reassemble compared to the invention, making a mistake less likely with the invention. Designs according to the invention are preferred because they are simpler and safer.

In a typical prior art unit the actuator arms are formed as part of the barrel of the hydraulic cylinder. Integrating the pins with such arms would be difficult or impossible to machine and difficult to assemble. Accordingly, in one preferred embodiment of the invention, the pivot pins are replaced by cylindrical projections integral with end fittings of the cylinder which include the end glands. This makes the concept feasible by permitting relatively easy machining of the cylindrical projections and easy assembly of the apparatus.

DETAILED DESCRIPTIONS OF THE PREFERRED EMBODIMENTS

Figure 1:
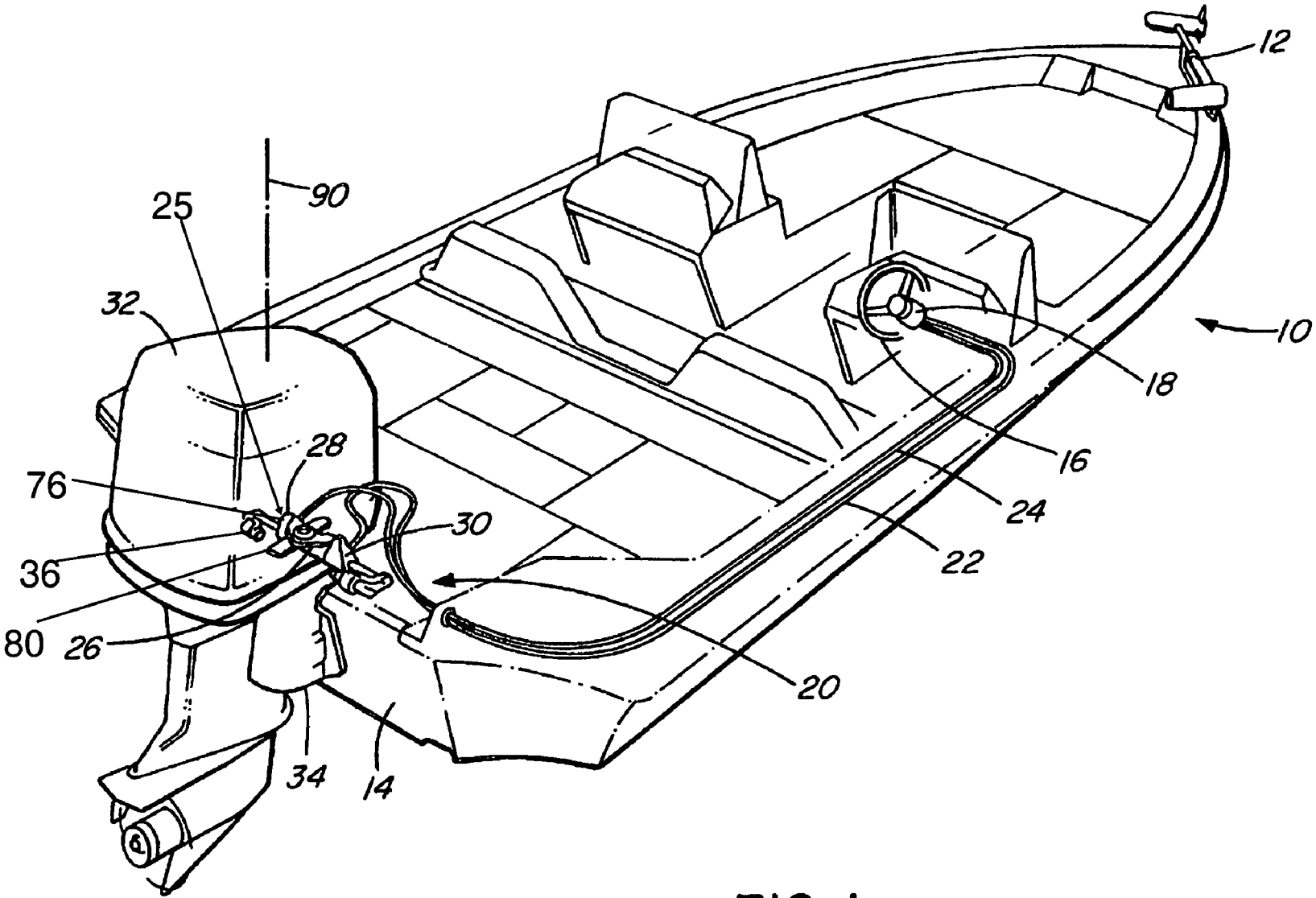
FIG. 1 is a top, rear isometric view of a boat fitted with an outboard motor and a hydraulic steering system according to an embodiment of the invention.

Referring to the drawings, and first to FIG. 1, this shows a boat 10 which is generally conventional and, accordingly, is only described briefly. The boat has a bow 12 and a stern 14. There is a steering wheel 16 fitted to a hydraulic pump 18. The pump 18 is hydraulically connected to a hydraulic steering system 20 by two hydraulic lines 22 and 24. The steering system includes a steering actuator 25 which includes a cylinder 26 having opposite ends 28 and 30. Hydraulic line 24 is connected to end 30, while hydraulic line 22 is connected to end 28. The steering system is mounted on a conventional outboard motor 32 having a midsection 34. Although the hydraulic steering system 20 is shown in conjunction with an outboard motor, the system is also useful for other tiltable outboard propulsion units, such as propulsion units for inboard/outboard drives.

Figure 2:
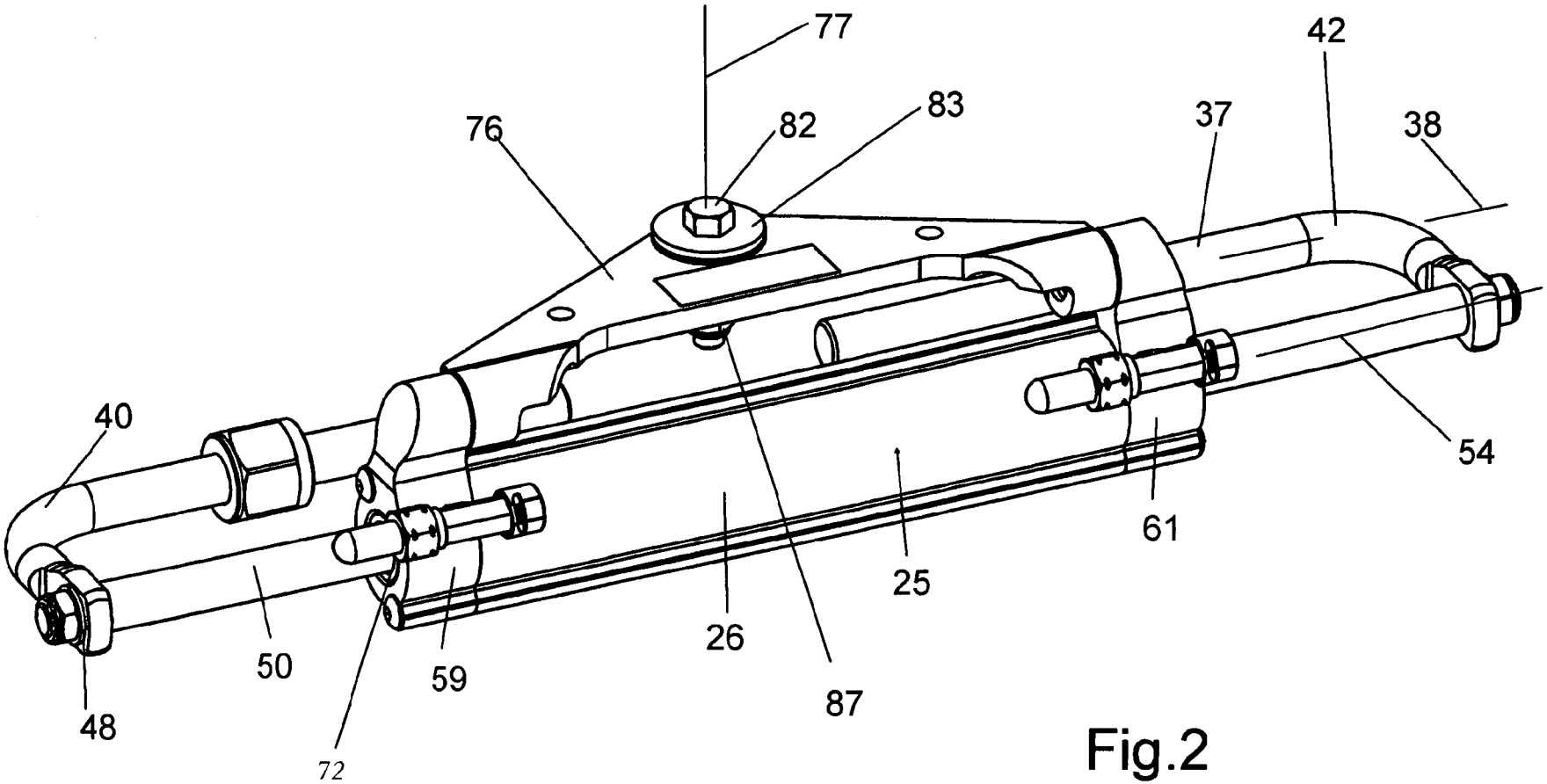
FIG. 2 is a top, front isometric view of a hydraulic steering assembly according to an embodiment of the invention.

Midsection 34 of the motor has a tilt tube 36 with support rod 37, shown in FIG. 2, passing therethrough which allows the motor to be tilted about a tilt axis 38 from the running position shown at FIG. 1, to a tilted position where the motor is tilted toward the bow 12 of the boat.

Figure 3:
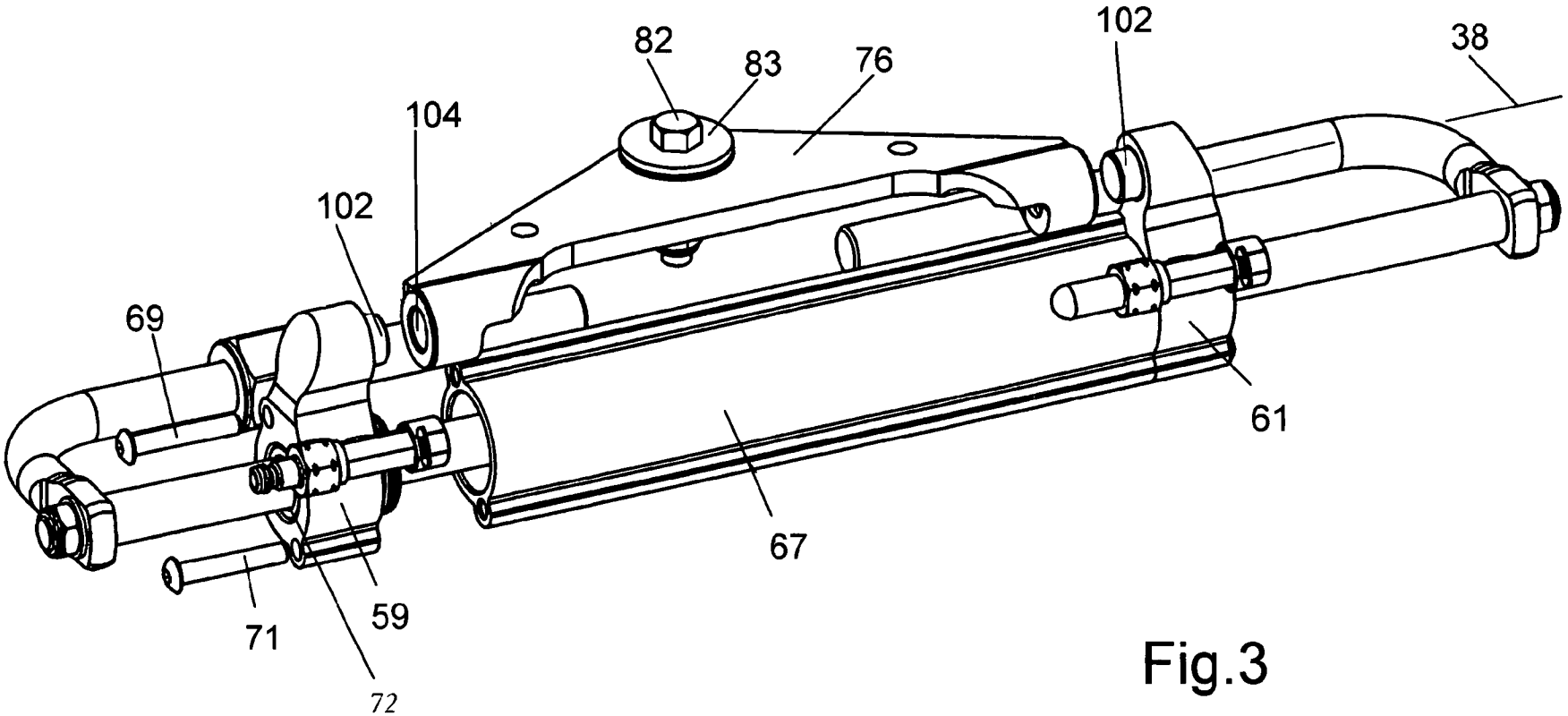
FIG. 3 is an exploded isometric view thereof.

A pair of support arms 40 and 42 are mounted on opposite ends of the support rod. Each arm has an aperture 48, shown for arm 40, which connects each arm to one end of a piston rod 50 of hydraulic actuator 25. The piston rod is reciprocatingly mounted within the cylinder 26, and extends through end fittings 59 and 61 of the cylinder, for relative movement along a piston rod axis 54 (also referred to herein as an "actuator axis"). As shown in FIGS. 2 and 3, at least one of the end fittings 59 and 61, and thus at least one of the corresponding actuator arms 100, is removeable by bolts. As shown in FIGS. 2 and 3. end glands 72 are integrated with the end fittings 59 and 61. The rod 50 is axially stationary with respect to the boat, while the cylinder 26 reciprocates. The support arms allow arcuate movement of the piston rod 50 and the actuator 25 about the tilt axis 38, while maintaining the rod axis 54 parallel to the tilt axis 38.

There is a member, in this case a pivot plate 76, which is pivotally connected to tiller arm 80 of the motor 32, by a tiller joint formed by bolt 82 as well as washer 83, nut 87 and a bushing extending through the aperture in the pivot plate (not shown) to permit pivoting about a first link axis 77 which is parallel to the steering axis 90.

Figure 4:
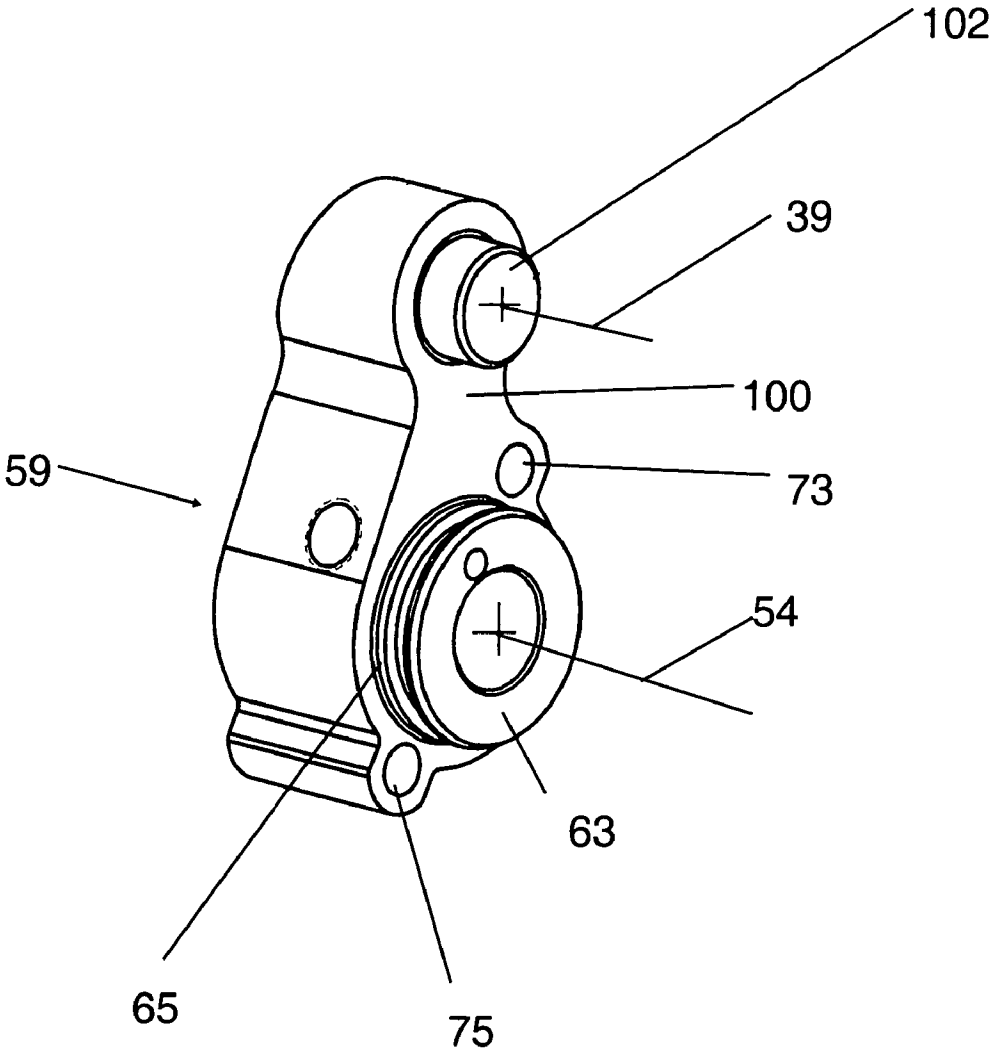
FIG. 4 is an isometric view of one of the end fittings thereof.
Figure 5:
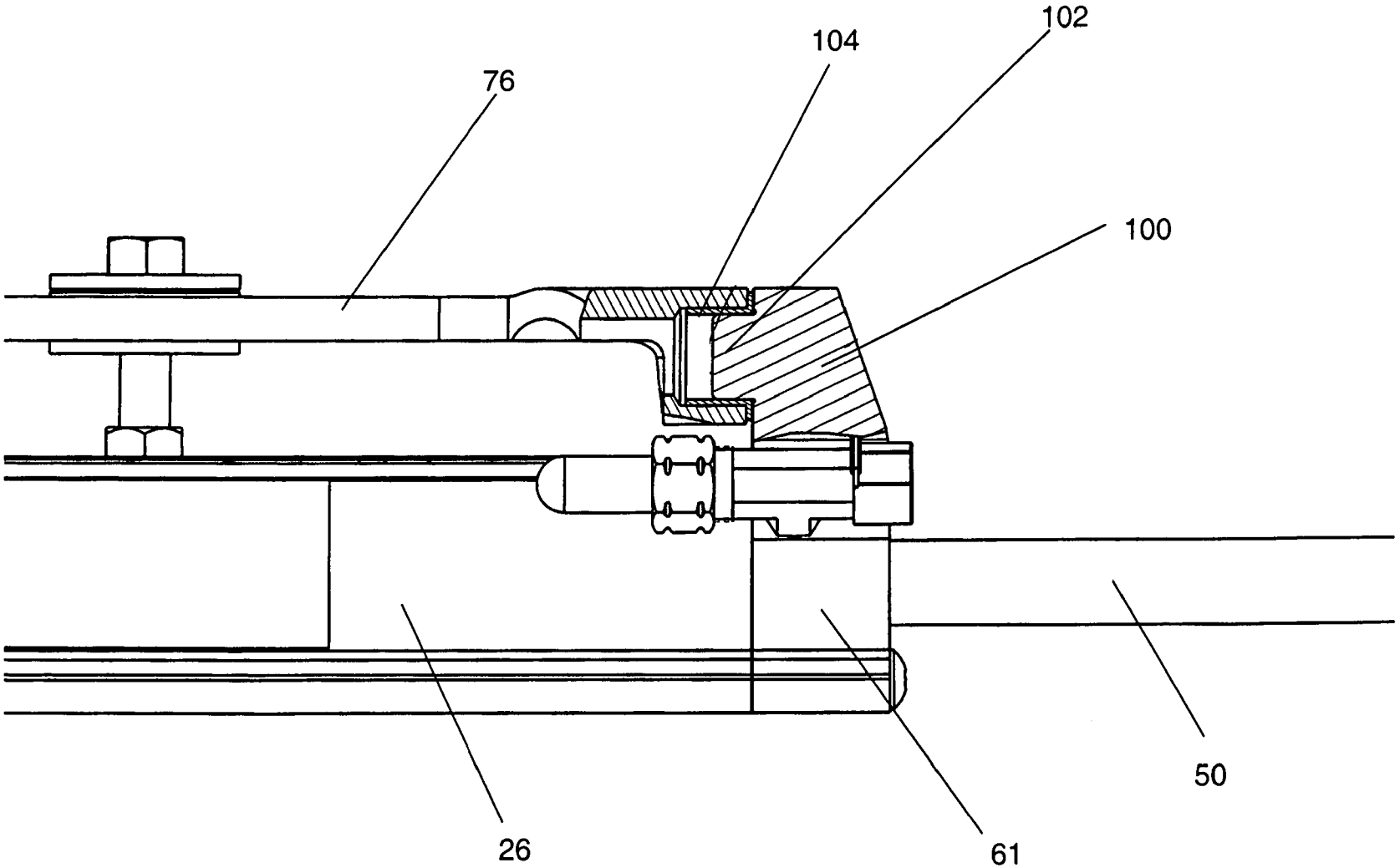
FIG. 5 is a fragmentary, elevational view, partly in section, showing a fragment of the hydraulic actuator and a fragment of the pivot plate with the pivotal connection therebetween.

End member or end fitting 59 is shown in better detail in FIG. 4. The end members each has an annular projection 63 which fits within one end of barrel 67 to form the cylinder 26. Bolts 69 and 71 extend through aperture 73 and 75 of each end member to connect the end members to barrel 67 of the cylinder shown in FIG. 3. Annular groove 65 receives an O-ring (not shown) for sealing the end of the cylinder. Member 61 is a mirror image of member 59. Each member includes an actuator arm 100 which extends radially outwards with respect to piston rod axis 54. Each arm has an integral cylindrical projection 102 axially aligned with second link axis 39 as may be appreciated best from FIG. 4. The cylindrical projection of each of the arms is rotatably received within a complementary cylindrical recess 104 of the pivot plate 76 shown in FIG. 3. Accordingly the cylindrical recesses and the complementary cylindrical recesses serve to pivotally connect the actuator arms 59 and 61 to pivot plate 76 for pivoting about axis 39. The projections 102 in this example are 0.625" in diameter and 0.3" long for an actuator rated for a 150 h.p. motor. The size would vary depending upon the particular application.

As may be seen best in FIG. 4, each of the arms 100 and the corresponding cylindrical projection 102 comprises a single piece of material. In fact, in this embodiment the entire end fitting 59 is a single piece aluminum extrusion, with projection 102 being machined. The projection 102 is anodized in this example and is sufficiently large to form a pivotal connection with the corresponding recess 104 to reliably connect the actuator to the pivot plate in the pivotable manner. In this example the material is 6061-T6 aluminum with standard black anodizing. The material could vary in other embodiments.

FIG. 1 shows the motor and tiller arm 80 at the center position of the tiller arm which corresponds to steering the boat straight ahead. When hydraulic fluid is pumped into the actuator 25 from pump 18 through either hydraulic line 22 or 24, the motor 32 is steered toward one of the hard over positions. For example, when hydraulic fluid is pumped through hydraulic line 22, it moves the cylinder 26 and the tiller arm 80 to the left from the point of view of FIG. 1. The actuator arms 100 of each of the end fittings 59 and 61 pivot about the piston rod axis 54, from a position angled forwardly from the motor 32 when the motor is at the center position, to a position angled rearwardly toward the motor at either of the hard over positions. At the same time, pivoting between the pivot plate 76 and the actuator arms about second link axis 39 is accommodated by rotation of the cylindrical members 102 of the arms within cylindrical recesses 104 of the pivot plate. The second link axis 39 and the piston rod axis remain parallel as the pivot plate 76 pivots with respect to the tiller arm and as the cylinder 26 of the actuator 25 reciprocates along piston rod 50.

Figure 6:
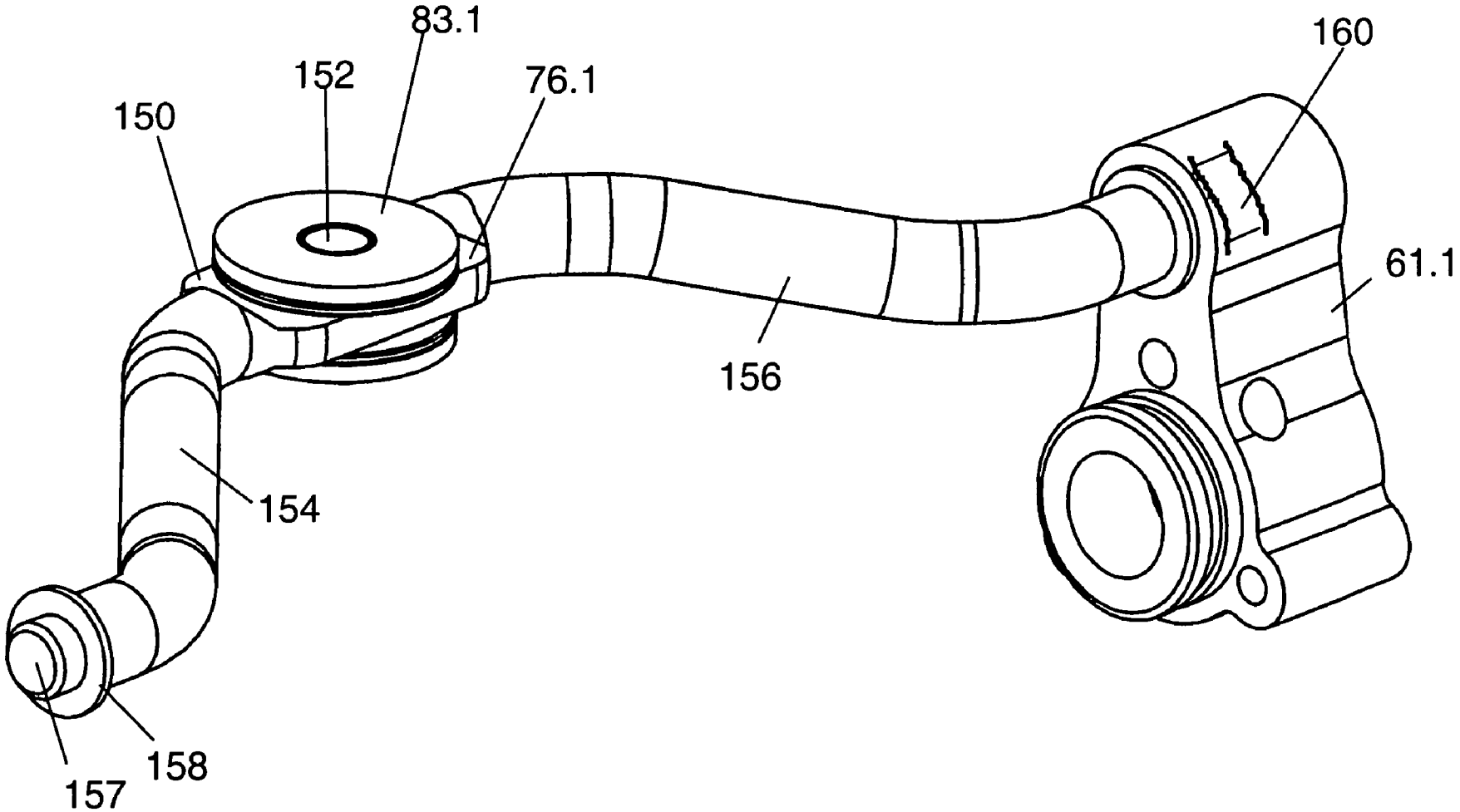
FIG. 6 is an isometric view of a pivot member and end fitting for a hydraulic cylinder according to an alternative embodiment of the invention.

A variation of the invention is shown in FIG. 6 wherein like parts have like numbers with the additional designation "0.1". In this embodiment the pivot plate 76 is replaced by an elongated pivot member 76.1 which is generally U-shaped. The member 76.1 has a flat portion 150 for receiving the bolts to pivotally connect the member to the tiller arm. A generally Z-shaped member 154 extends from one side of the flat portion 150 and has an integral cylindrical projection 157 extending outwardly from washer 158. Member 156 on the opposite side is a mirror image of member 154. The member 76.1 has an aperture 152 extending therethrough which serves as means for pivotally mounting the pivot member to a tiller arm in the same manner as member 76 of the previous embodiment.

The end members are generally similar to the end members of the previous embodiment, but have a cylindrical recess 160 in place of the cylindrical projection 102. The construction is generally the opposite, compared with the previous embodiment, insofar as the pivotal connection between the member 76.1 and the end members of the actuator are concerned. In other words, the cylindrical projections are on the member 76.1 instead of on the end members of the actuator. However the cylindrical members 157 of the member 76.1 comprise a single piece with the rest of the member. The member in this embodiment is formed by a forged stainless steel bar with members 157 machined and washer 158 being installed over the member. Alternatively it could be an aluminum plate with the members 157 machined.

It will be understood by someone skilled in the art that many of the details provided above are given by way of example only and can be altered or deleted without departing from the scope of the invention as set out in the following claims.

What is claimed is:

1. A hydraulic steering assembly for applying a force to a tiller of a marine, outboard propulsion unit and for rotating said propulsion unit about a steering axis between a center position and hard over positions to each side of the center position, the propulsion unit being supported for arcuate movement about a tilt axis which is generally perpendicular to the steering axis, the steering assembly comprising:

a hydraulic steering actuator including a cylinder and an elongated piston rod reciprocatingly mounted within the cylinder and extending through the cylinder for movement along a piston rod axis, the piston rod having opposite ends;

a pair of support arms which are pivotable about the tilt axis of said propulsion unit and are connected to the piston rod near the opposite ends thereof, the support arms allowing arcuate movement of the rod about the tilt axis, maintaining the rod axis parallel to the tilt axis;

a pivot member pivotally mountable on the tiller of said propulsion unit for pivoting about a first link axis which is parallel to the steering axis;

a pair of actuator arms, each said actuator arm being connected to the cylinder and extending radially outwards with respect to the piston rod axis, at least one of said actuator arms being removable, each of the actuator arms having an integral cylindrical projection axially aligned with a second link axis which is parallel to the piston rod axis, each said cylindrical projection being rotatably received within a complementary cylindrical recess of the pivot member, thereby pivotally connecting the actuator arms to the member.

2. The steering assembly as claimed in claim 1, wherein the cylinder includes a barrel with opposite ends and an end fitting connected to the barrel at each end thereof, the piston rod extending slidably through the end fittings, the actuator arms being integral with the end fittings, each said end fitting including one of said actuator arms.

3. The steering assembly as claimed in claim 2, wherein each of the end fittings includes an end gland.

4. The steering assembly as claimed in claim 3, wherein each said end fitting, including one of the actuator arms, one of the end glands, and one of the cylindrical projections, is one piece.

5. The steering assembly as claimed in claim 3, wherein each said end fitting, including one of the actuator arms, one of the end glands, and one of the cylindrical projections, is a one-piece aluminum member.

6. The steering assembly as claimed in claim 3, wherein the end fittings are of aluminum and the projections are anodized.

7. A hydraulic steering assembly for applying a force to a tiller of a marine, outboard propulsion unit and for rotating said propulsion unit about a steering axis between a center position and hard over positions to each side of the center position, the propulsion unit being supported for arcuate movement about a tilt axis which is generally perpendicular to the steering axis, the steering assembly comprising:

a hydraulic steering actuator including a cylinder and an elongated piston rod reciprocatingly mounted within the cylinder and extending through the cylinder for movement along a piston rod axis, the piston rod having opposite ends;

a pair of support arms which are pivotable about the tilt axis of said propulsion unit and are connected to the piston rod, allowing arcuate movement of the rod about the tilt axis, maintaining the rod axis parallel to the tilt axis;

a pivot member pivotally mountable on the tiller of said propulsion unit for pivoting about a first link axis which is parallel to the steering axis the pivot member having a pair of integral cylindrical projections; and a pair of actuator arms, each said actuator arm being connected to the cylinder and extending radially outwards with respect to the piston rod axis, at least one of said actuator arms being removable, each of the actuator arms having a cylindrical recess aligned with a second link axis which is parallel to the piston rod axis, the integral cylindrical projections being rotatably received within the recesses, thereby pivotally connecting the actuator arms to the member.

8. The steering assembly as claimed in claim 7, wherein the cylindrical projections are formed in one piece with the pivot member and each said actuator arm has end glands, each said end gland being integral with one of the actuator arms.

9. The steering assembly as claimed in claim 8, wherein the pivot member is of aluminum and the projections are anodized.

10. A hydraulic steering assembly for applying a force to a tiller of a marine, outboard propulsion unit and for rotating said propulsion unit about a steering axis between a center position and hard over positions to each side of the center position, the propulsion unit being supported for arcuate movement about a tilt axis which is generally perpendicular to the steering axis, the steering assembly comprising:

a hydraulic steering actuator including a cylinder and an elongated piston rod reciprocatingly mounted within the cylinder and extending through the cylinder for movement along a piston rod axis, the piston rod having opposite ends;

a pair of support arms which are pivotable about the tilt axis of said propulsion unit and are connected to the piston rod near the opposite ends thereof the support arms allowing arcuate movement of the rod about the tilt axis, maintaining the rod axis parallel to the tilt axis;

a pivot member pivotally mounted on the tiller of said propulsion unit for pivoting about a first link axis which is parallel to the steering axis;

a pair of actuator arms, each said actuator arm being connected to the cylinder, at least one of said actuator arms being removable, each said actuator arm having a portion extending radially outwards with respect to the piston rod axis; and a pivotal connection between each said actuator arm and said pivot member including a cylindrical projection integral with one of said each actuator arm and said pivot member and a complementary cylindrical recess on another of said each actuator arm and said pivot member rotatably receiving the cylindrical projection, said pivotal connection permitting relative pivoting between the actuator arms and the pivot member about a second link axis which is parallel to the piston rod axis.

11. The steering assembly as claimed in claim 10, wherein the cylindrical projection and said one of said each actuator arms and said pivot member comprise one piece.

12. The steering assembly as claimed in claim 10, wherein said one of said each actuator arms and said pivot member and the cylindrical projection thereof is a one-piece aluminum member.

13. The steering assembly as claimed in claim 10, wherein said one of said each actuator arms and said pivot member is of aluminum and the projection is anodized.

14. The steering assembly as claimed in claim 10, wherein the cylindrical projection is axially aligned with the second link axis.

* * * * *